US012129776B2

(12) United States Patent
Chandra Kumar et al.

(10) Patent No.: US 12,129,776 B2
(45) Date of Patent: Oct. 29, 2024

(54) SEPARATOR FOR SEPARATING FLUID FROM A GAS FLOW AND ASSEMBLY KIT FOR A SEPARATOR

(71) Applicant: MANN+HUMMEL GmbH, Ludwigsburg (DE)

(72) Inventors: Karun Chandra Kumar, Karnataka (IN); Chowalloor Rapheal Antomon, Bengaluru (IN); Rohit Dattatray Surve, Karnataka (IN); Thomas Schleiden, Oberstenfeld (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 179 days.

(21) Appl. No.: 17/895,287

(22) Filed: Aug. 25, 2022

(65) Prior Publication Data

US 2023/0003147 A1 Jan. 5, 2023

Related U.S. Application Data

(63) Continuation of application No. PCT/EP2021/052849, filed on Feb. 5, 2021.

(30) Foreign Application Priority Data

Feb. 26, 2020 (DE) ..... 10 2020 105 029.1

(51) Int. Cl.
*B01D 46/00* (2022.01)
*F01M 13/04* (2006.01)

(52) U.S. Cl.
CPC ..... *F01M 13/04* (2013.01); *F01M 2013/0477* (2013.01)

(58) Field of Classification Search
CPC ..... B01D 46/10; B01D 45/08; F01M 13/04; F01M 2013/0433; Y10S 55/14
USPC ..... 55/309
See application file for complete search history.

(56) References Cited

U.S. PATENT DOCUMENTS

| | | | | |
|---|---|---|---|---|
| 5,562,087 | A | 10/1996 | Wright | |
| 6,290,738 | B1 | 9/2001 | Holm | |
| 10,519,826 | B2 * | 12/2019 | Ratajczack | B01D 45/08 |
| 2006/0059875 | A1 | 3/2006 | Malgorn et al. | |
| 2006/0062699 | A1 | 3/2006 | Evenstad et al. | |

(Continued)

FOREIGN PATENT DOCUMENTS

WO 17153136 A1 9/2017

*Primary Examiner* — Long T Tran
*Assistant Examiner* — James J Kim

(57) ABSTRACT

A separator for separating liquid from a gas flow is provided with a nozzle carrier element provided with a nozzle arrangement having one or more nozzles. An impact element is arranged downstream in flow direction of the gas flow at least partially opposite the nozzle arrangement. A permanent cover device is provided that covers at least one of the one or more nozzles of the nozzle arrangement. The permanent cover device reduces by at least 50% a through-flow of the gas flow through the at least one of the one or more nozzles of the nozzle arrangement compared to the one or more nozzles of the nozzle arrangement that are free from the permanent cover device. An assembly kit for producing such a separator is provided with a nozzle carrier element with nozzle arrangement and one or more nozzles, an impact element, a cover device, and a liquid reservoir.

20 Claims, 12 Drawing Sheets

(56) References Cited

U.S. PATENT DOCUMENTS

| | | | | |
|---|---|---|---|---|
| 2006/0249128 | A1 | 11/2006 | Shieh | |
| 2008/0155949 | A1 | 7/2008 | Dunsch et al. | |
| 2009/0193770 | A1* | 8/2009 | Holzmann | F01M 13/04 55/318 |
| 2009/0250044 | A1 | 10/2009 | Braun et al. | |
| 2011/0030629 | A1 | 2/2011 | Schleiden | |
| 2017/0114687 | A1* | 4/2017 | Severance | F01M 13/0416 |

* cited by examiner

SEPARATOR FOR SEPARATING FLUID FROM A GAS FLOW AND ASSEMBLY KIT FOR A SEPARATOR

CROSS-REFERENCE TO RELATED APPLICATIONS

This application is a continuation application of international application No. PCT/EP2021/052849 having an international filing date of 5 Feb. 2021 and designating the United States, the international application claiming a priority date of 26 Feb. 2020 based on prior filed German patent application No. 10 2020 105 029.1, the entire contents of the aforesaid international application and the aforesaid German patent application being incorporated herein by reference.

TECHNICAL FIELD

The invention concerns a separator for a liquid from a gas flow and an assembly kit for a separator.

BACKGROUND

In reciprocating piston combustion engines, an oil-containing leakage gas is generated in the crankcase, the so-called blow-by gas. Its return into the combustion process is required by law worldwide and is realized in so-called closed crankcase venting systems. The most important tasks of a crankcase venting system include the oil separation and oil return into the crankcase as well as the control of the crankcase pressure. In this context, the requirements placed on the oil separation have steadily increased in recent years with the exhaust gas regulations becoming more stringent in order to protect emission-relevant engine components such as exhaust gas turbochargers, charge air coolers or sensors from performance loss by oil contamination. The oil separation provides a contribution to the minimization of the oil consumption as well as also an important contribution in regard to observing the exhaust gas regulations over the vehicle service life.

EP 3100780 A1 discloses an oil separator with an exchangeable filter element.

SUMMARY OF THE INVENTION

The invention is based on the object of providing a beneficial separator for a liquid from a gas flow that is suitable as a lifetime component.

A further object is providing an assembly kit for such a separator.

The aforementioned object is solved according to an aspect of the invention by a separator for separation of liquid from a gas flow, in particular for separation of oil from a blow-by gas in a crankcase venting system, comprising at least one nozzle carrier element with at least one nozzle arrangement with at least one nozzle, and comprising an impact element arranged downstream at least partially opposite the nozzle arrangement, wherein a permanent cover device for one or more nozzles of the nozzle arrangement is provided that reduces by at least 50% a through-flow of the gas flow through the one or more nozzles in relation to nozzles that are free from the cover device.

The permanent cover for one or more nozzles of the nozzle arrangement can be changed in the context of the initial assembly of the separator or for recurrent servicing events. In this context, the cover can be completely or partially removed from individual nozzles of the nozzle arrangement. A function as a controlling or regulating member, for example, of a valve, is not provided. The cover device is no valve body that changes its position in operation but is fixedly adjusted and unchanged across all operating states.

The further object is solved by an assembly kit for a separator, at least comprising a nozzle carrier element with at least one nozzle arrangement which comprises at least one nozzle; an impact element for arrangement downstream of the nozzle arrangement; a cover device for one or more nozzles of the nozzle arrangement that reduces by at least 50% a through-flow of the gas flow through the one or more nozzles in comparison to nozzles that are free from the cover device, wherein at least the nozzle carrier element, the impact element or/and a liquid reservoir are provided as carry over parts for different nozzle arrangements or number of nozzles.

Beneficial embodiments and advantages of the invention result from the additional claims, the description, and the drawing.

A separator for separating liquid from a gas flow is proposed, in particular for separating oil from a blow-by gas in a crankcase venting system, comprising at least one nozzle carrier element with at least one nozzle arrangement with at least one nozzle, and comprising an impact element arranged downstream at least partially opposite the nozzle arrangement. A permanent cover device is provided for one or more nozzles of the nozzle arrangement that reduces by at least 50% a through-flow of the gas flow through the one or more nozzles in comparison to nozzles that are free from the cover device.

Preferably, the through-flow of the gas flow is reduced by at least 80%, particularly preferred by at least 95%. In that during assembly of the separator it can be determined which nozzles can be flowed through freely and which can be flowed through less or not at all, it can be achieved that separators for entirely different through-flows of the gas flow from a minimal to a maximal gas flow can be realized with identical components. In this way, for example, separators for entirely different performance classes of internal combustion engines can be produced with identical components.

Advantageously, the separator can be configured without filter element and the separated liquid can directly drain or the separated liquid can be collected in a reservoir. An exchange of a filter element, and thus an at least partial removal of the separator, is not necessary. Optionally, a filter element can however be arranged downstream of the separator.

According to a beneficial embodiment of the separator, a downstream distance, in relation to the nozzles, between nozzles and cover device can be smaller by at least 50% than a downstream distance between the impact element and the nozzles that are free from the cover device. Beneficially, the cover device can rest, for example, on the corresponding nozzles. For example, the impact element can comprise the cover device.

According to a beneficial embodiment of the separator, the nozzle carrier element and the impact element can comprise a positioning device with complementary positioning elements with which a relative position, in particular rotatory position, between cover device and nozzle arrangement can be fixed. For example, a positioning element can be formed by a projection, for example, in the form of at least one pin, in particular of a radially extending pin, and the complementary positioning element by one or more receptacles for the projection. The pin can be formed at the nozzle carrier element and a plurality of receptacles can be formed at the impact element, or vice versa.

According to a beneficial embodiment of the separator, the cover device can be arranged upstream of the nozzle arrangement. In particular, an upstream distance, in relation to the nozzles, between nozzles and cover device can be smaller by at least 50% than an upstream distance between the impact element and the nozzles that are free from the cover device. For example, a separate element can be arranged, viewed in the flow direction, in front of the nozzle arrangement that comprises an opening through which one or more nozzles are accessible unhindered for the gas flow.

According to a beneficial embodiment of the separator, the nozzle carrier element and the cover device can comprise a positioning device with complementary positioning elements with which a rotatory position between cover device and nozzle arrangement can be fixed. This is beneficial when nozzle carrier element and cover device are arranged coaxially to each other.

According to a beneficial embodiment of the separator, the nozzle carrier element can comprise a receptacle in which the impact element is arranged. The nozzle carrier element can have a pot-shaped cutout into which the impact element can be placed. Advantageously, nozzle carrier element and impact element can be arranged concentrically.

According to a beneficial embodiment of the separator, the nozzle carrier element can be arranged in a receptacle of a liquid reservoir. Advantageously, the liquid reservoir can have a drainage valve through which the liquid reservoir can be emptied from time to time.

According to a beneficial embodiment of the separator, the cover device can be integrated in the impact element. This enables a particularly compact configuration.

According to a beneficial embodiment of the separator, the cover device can be configured as a flat ring or ring segment. Advantageously, the ring or ring segment can be arranged in front of a ring-shaped or ring segment-shaped nozzle arrangement.

According to a beneficial embodiment of the separator, the cover device can be configured as a ring-type body with round or angular cross section. For example, the body can be a cylinder or a cuboid. The cross section of the body can be configured triangular or polygonal, for example, hexagonal. The corners of the cover device can serve as part of the positioning device and enable a positioning of a complementarily designed nozzle carrier element whose corners can also be part of the positioning device.

According to a beneficial embodiment of the separator, the cover device can be embodied as a cover. Alternatively or additionally to a coaxial arrangement, a separate cover can be arranged upstream of the nozzle arrangement.

According to a beneficial embodiment of the separator, the impact element and the nozzle carrier element can be arranged concentrically or coaxially about an axis. The corresponding arrangement can be selected depending on existing installation space and/or requirements on the separator.

According to a beneficial embodiment of the separator, the nozzle arrangement can be arranged as a circular segment or ring segment in the nozzle carrier element. A maximal number of nozzles can be realized on a tight installation space. In particular, the nozzle carrier element and the impact element can be arranged perpendicularly to the axis. For example, nozzle arrangement and impact element can interact with ring-shaped regions.

According to a beneficial embodiment of the separator, the nozzle arrangement can be arranged in a wall segment of the nozzle carrier element that is embodied parallel to the axis. Advantageously, a coaxial arrangement of a nozzle carrier element and impact element can be selected. In particular, the nozzle carrier element and the impact element can be arranged parallel to the axis. This is particularly beneficial in order to provide a maximal number of nozzles in a small installation space.

According to a further aspect of the invention, an assembly kit for a separator is proposed, comprising at least a nozzle carrier element with at least one nozzle arrangement which comprises at least one nozzle; an impact element for arrangement downstream of the nozzle arrangement; a cover device for one or more nozzles of the nozzle arrangement that reduces by at least 50% a through-flow of the gas flow through the one or more nozzles in comparison to nozzles that are free from the cover device, wherein the nozzle carrier element, the impact element, and a liquid reservoir in a special embodiment are provided as carry over parts for different nozzle arrangements and/or number of nozzles.

Advantageously, with such an assembly kit with carry over parts, numerous separators can be produced which exhibit different gas throughputs in that, upon assembly of the separator, more or fewer nozzles are covered or the distance between one or more nozzles and the cover element is reduced by at least 50% in relation to the downstream distance between the impact element and the nozzles.

The number of nozzles which are free from a cover device can be selected depending on a required differential pressure that is a function of the throughput rate of the blow-by gas. With particular advantage, the nozzle carrier element, the impact element and/or the liquid reservoir can be designed as carry over parts. The nozzle carrier element can comprise a maximal number of nozzles. Due to a positioning device with complementary positioning elements, it can be determined by a suitable arrangement of the complementary positioning elements relative to each other which nozzles can be flowed through substantially freely and which nozzles are covered, or the distance between one or more nozzles and the cover element is reduced by at least 50%. Likewise, the ring-shaped cover element can be designed as carry over part.

For example, maximally twelve nozzles can be provided in the nozzle carrier element and a through-flow region with minimal through-flow through a nozzle and maximal through-flow through all twelve nozzles can be exploited.

According to a beneficial embodiment of the assembly kit, complementary positioning elements can be provided at the nozzle carrier element and the impact element with which a relative position between the cover device and the nozzle arrangement can be fixed. This enables a simple assembly of separators from carry over parts for different performance classes.

According to a beneficial embodiment of the assembly kit, the cover device can coaxially surround the nozzle carrier element. Depending on positioning of the cover device in relation to the nozzle carrier element, more or fewer nozzles can be covered upon assembly of the separator.

BRIEF DESCRIPTION OF THE DRAWINGS

Further advantages result from the following drawing description. In the drawings, embodiments of the invention are illustrated. The drawings, the description, and the claims contain numerous features in combination. A person of skill in the art will consider the features expediently also individually and combine them to expedient further combinations.

DESCRIPTION OF PREFERRED EMBODIMENTS

Figure 1:
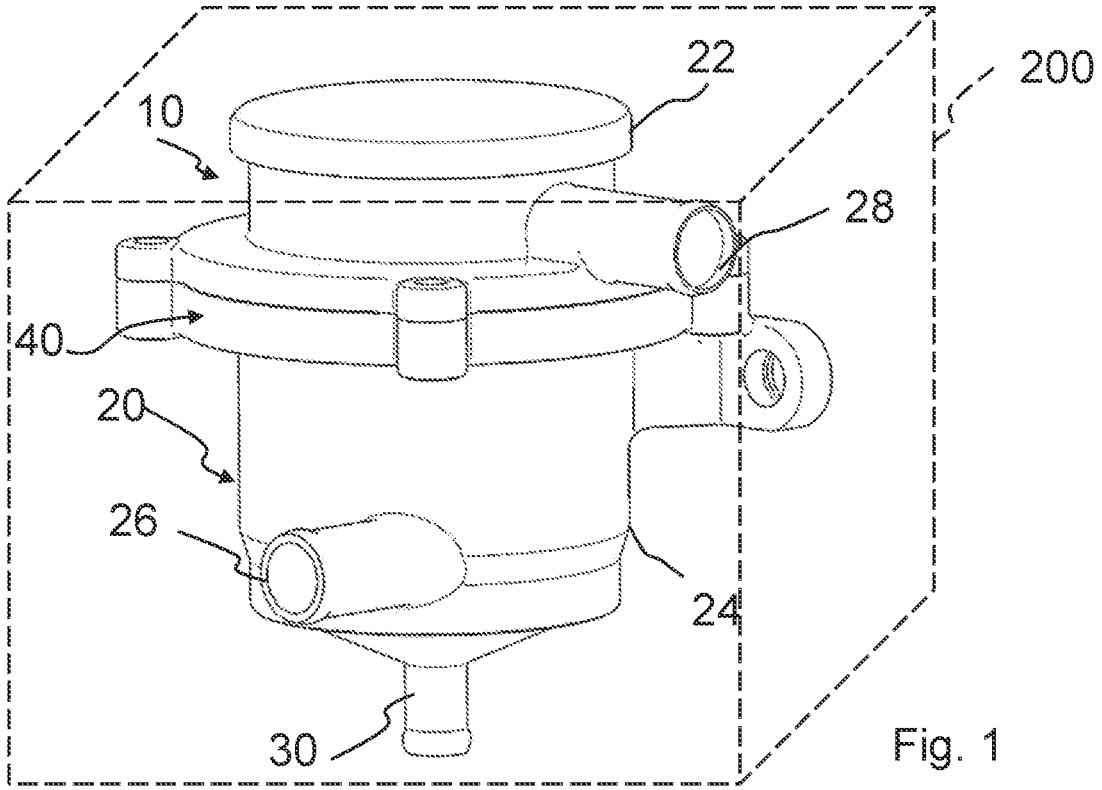
FIG. 1 shows a crankcase venting system with a separator according to an embodiment of the invention.

In the Figures, same or similar components are identified with same reference characters.

FIG. 1 shows schematically a crankcase venting system 200 with a separator 10 arranged therein according to an embodiment of the invention for separating oil from blow-by gases in the crankcase venting system 200. The separator 10 comprises a housing 20 with an inlet 26 and an outlet 28 for a gas flow as well as an oil drain 30 for oil separated in the separator from the gas stream. The inlet 26 is arranged in a bottom housing part 24 and the outlet 28 in a top housing part 22 of the housing 20. The two housing parts 22, 24 are connected by means of a gas-tight flange connection 40, for example, screwed.

Figure 2:
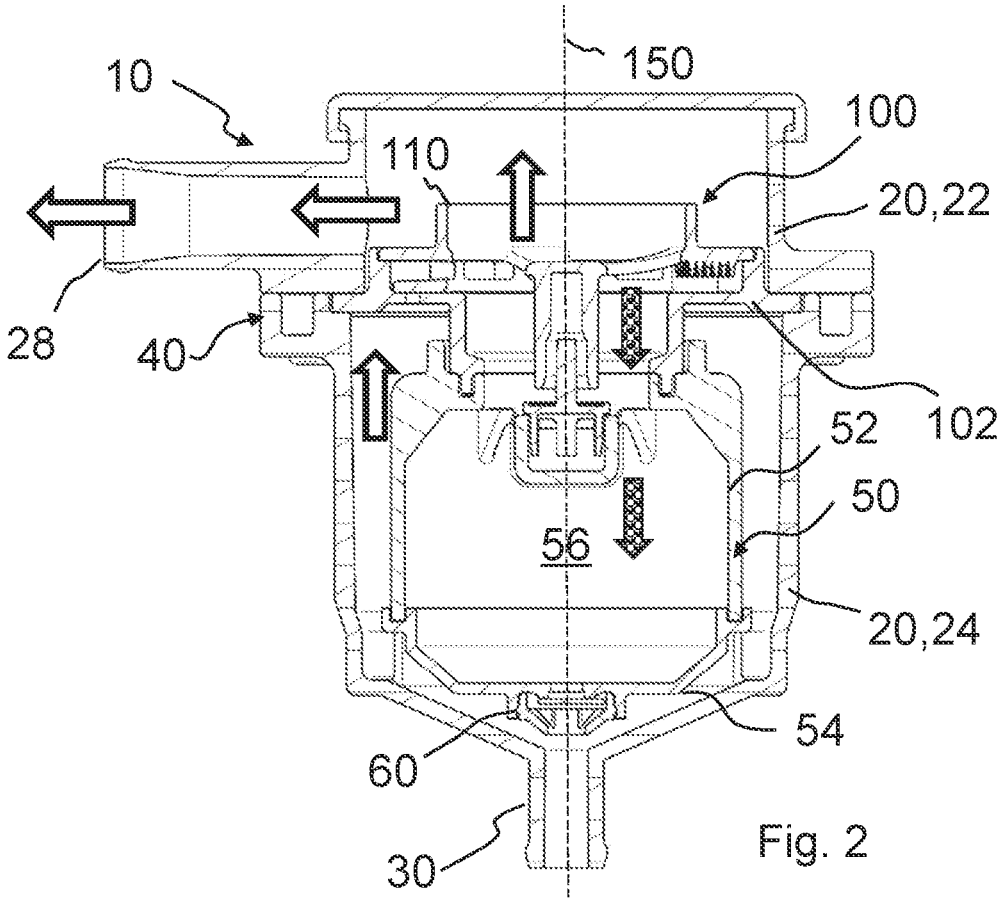
FIG. 2 shows a separator with a separation module according to an embodiment of the invention.
Figure 3:
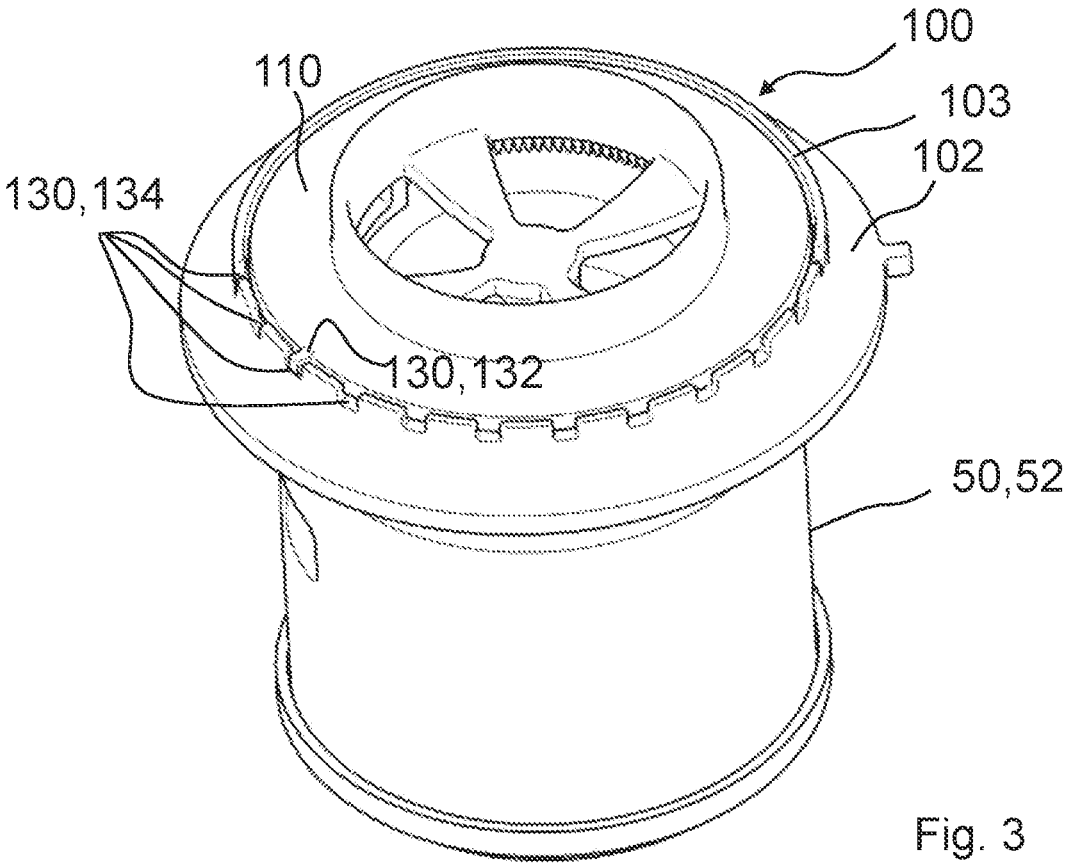
FIG. 3 shows the separation module of the separator according to FIG. 2 in perspective view at a slant from above.

FIGS. 2 to 11 show different views of a separator 10 with separation module 100 as well as of its components according to an embodiment of the invention. FIG. 2 shows a longitudinal section through the separator 10, and FIG. 3 shows the separation module 100 of the separator 10 in perspective view at a slant from above.

Figure 4:
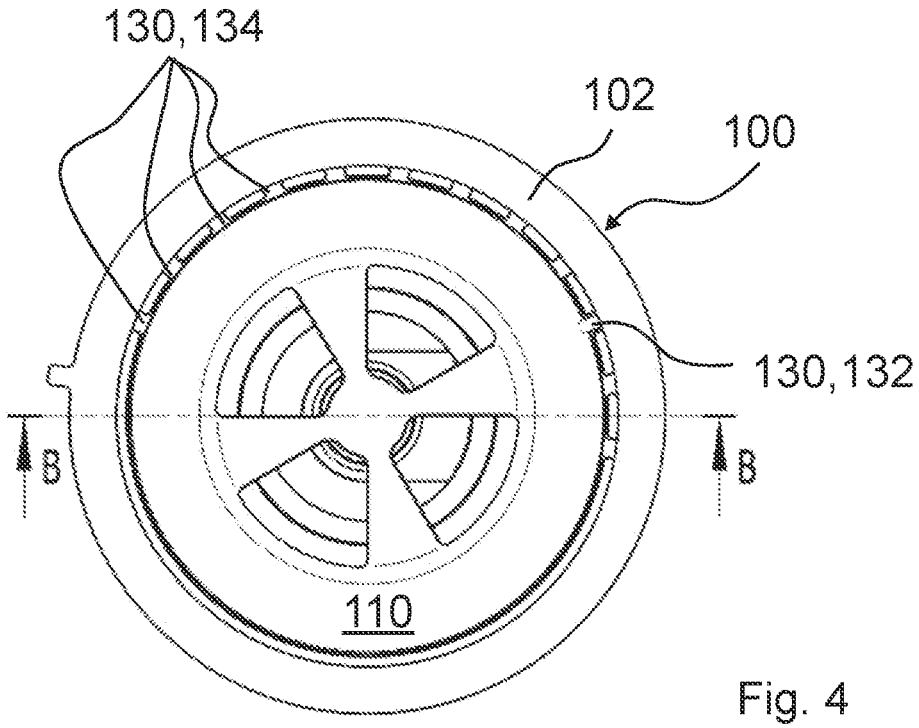
FIG. 4 shows the separator according to FIG. 2 with indicated section plane B-B in plan view.
Figure 5:
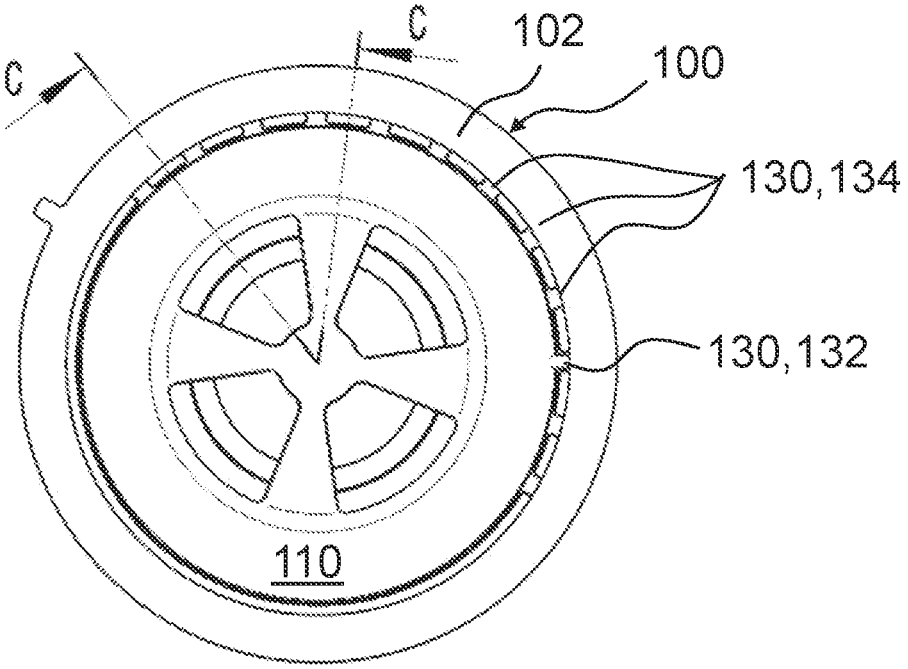
FIG. 5 shows the separation module of the separator according to FIG. 2 with indicated angled section plane C-C in plan view.
Figure 6:
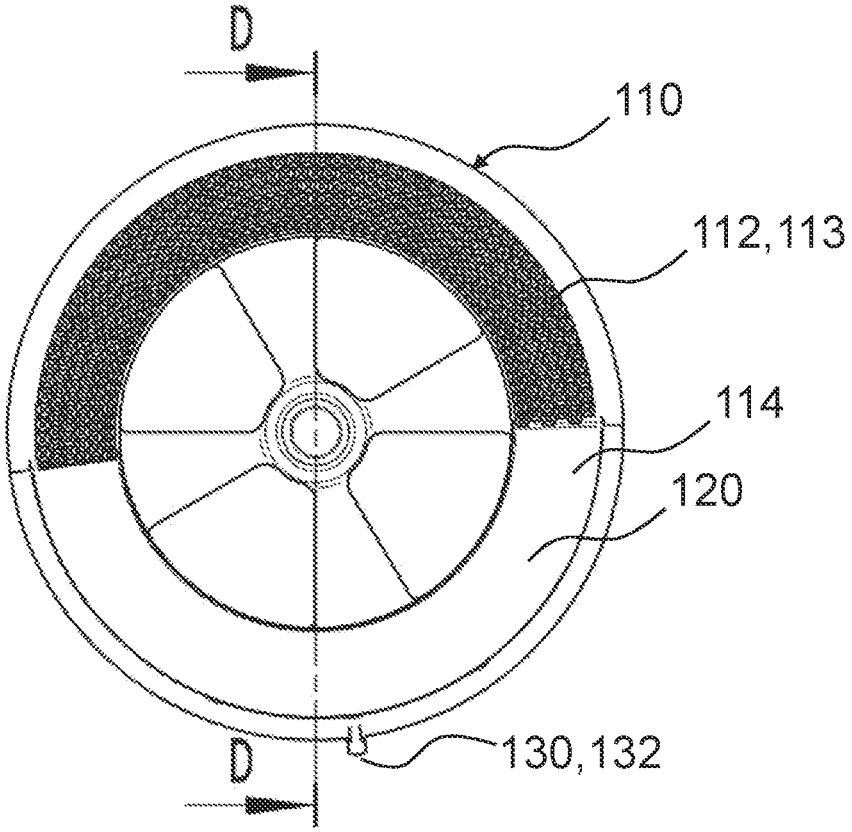
FIG. 6 shows the separation module of the separator according to FIG. 2 with indicated section plane D-D in plan view.

FIG. 4 shows the separation module 100 in plan view with indicated section plane B-B. FIG. 5 shows the separation module 100 with schematically shown angled section plane C-C in plan view. FIG. 6 shows an impact element 110 of the separator 10 with indicated section plane D-D in plan view.

As can be seen in the section illustration in FIG. 2, the separator 10, in the housing 20, comprises a separation module 100 that is adjoined by a liquid reservoir 50. The separation module 100 is connected to a first part 52 of the liquid reservoir 50 and projects with a rim into a receptacle of the liquid reservoir 50. In the adjoining second part 54, a drainage valve 60 is arranged through which the liquid reservoir 50 can be emptied. The liquid, for example, oil from blow-by gases, flows through the drainage valve 60 out of the interior 56 of the liquid reservoir 50 and through the outlet 30 out of the separator 10.

The gas flow toward outlet 28 out of the housing 20 is indicated in FIG. 2 with thick, black-rimmed arrows while the separated liquid flow toward liquid reservoir 50 is indicated with dotted arrows. The gas flow passes through a nozzle arrangement, not illustrated in the Figure, of a nozzle carrier element 102 to the outlet 28.

Figure 7:
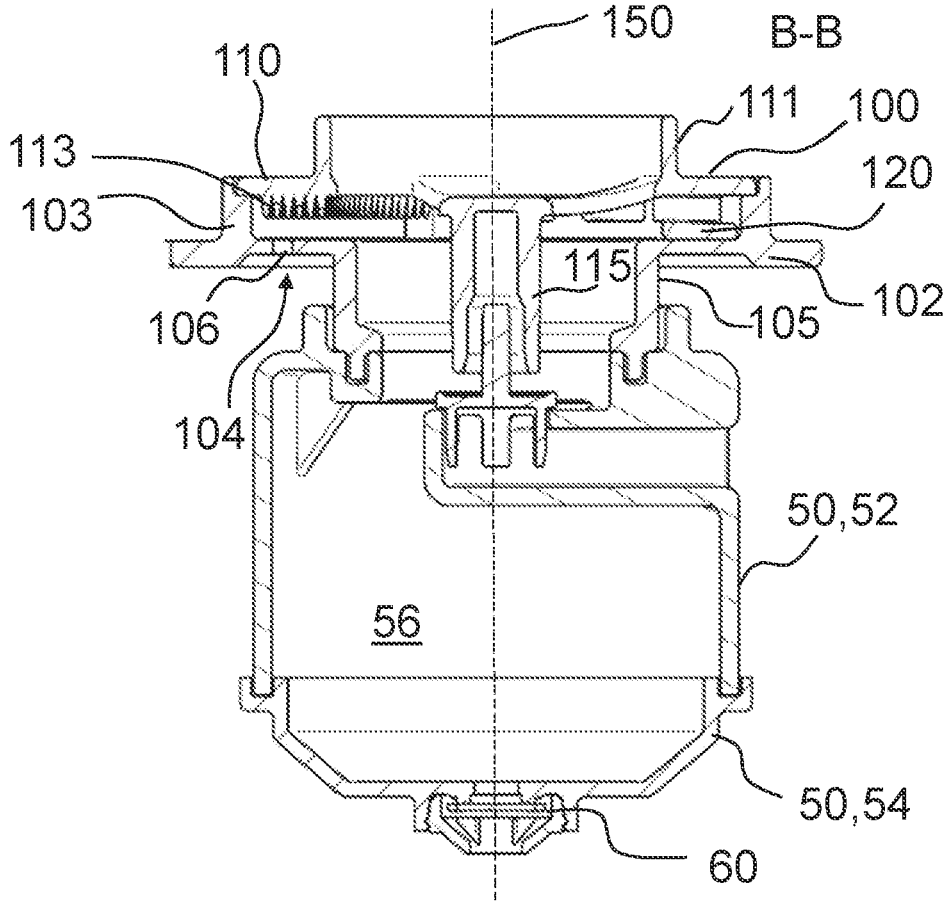
FIG. 7 shows a section view in the plane B-B of the separation module according to FIG. 2.
Figure 8:
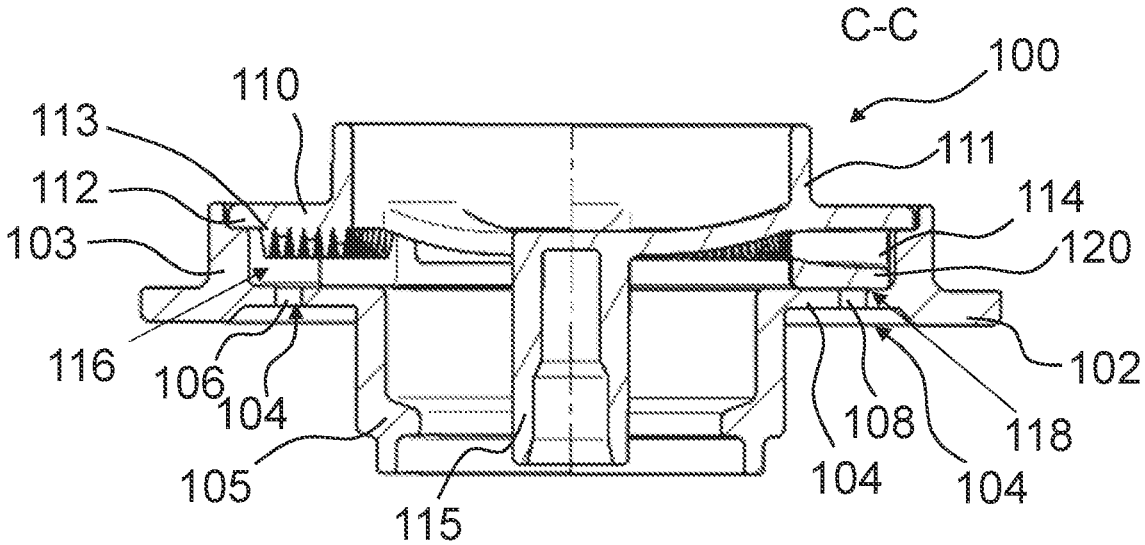
FIG. 8 shows a section view in the angled plane C-C of the separation module according to FIG. 2.

The separation module 100 of the separator 10 comprises a nozzle carrier element 102 into which an impact element 110 is inserted in a receptacle surrounded by a rim 103 (FIGS. 7, 8). Nozzle carrier element 102 and impact element 110 are arranged concentrically about an axis 150. The nozzle carrier element 102 is fixed with its rim between the flanges of the flange connection 40. In relation to the direction of the gas flow, the nozzle carrier element 102 is arranged upstream of the impact element 110.

As can be seen in FIG. 3, the nozzle carrier element 102 and the impact element 110 of the separation module 100 comprise a positioning device 130 with complementary positioning elements 132, 134. In the illustrated embodiment, a pin 132 is arranged at the rim of the impact element 110 and several receptacles 134, of which, for reasons of simplification, only some are identified with reference characters, in the rim 103 of the nozzle carrier element 102. The receptacles 134 are arranged, for example, as intermediate spaces of teeth which are arranged at the free end of the rim 103.

Beneficially, as many receptacles 134 as correspond to the maximal number of nozzles 106, 108 can be provided.

The relative, in particular rotatory, position of the impact element 110 in relation to the nozzle carrier element 102 can be selected in that a pin 132 is inserted into one of the receptacles 134 when the impact element 110 is placed into the receptacle surrounded by the rim 103 upon assembly of the separation module 100.

It is understood that the position of the complementary positioning elements 132, 134 can also be switched. Thus, the impact element 110 can comprise the receptacles 134 and the nozzle carrier element 102 the pin 132.

As shown in FIG. 6, the impact element 110 comprises two semi-circular segments 112, 114, wherein the segment 112 forms a pyramidal region 113 in which a plurality of pyramids are oriented with their tips toward a nozzle arrangement 104 of the nozzle carrier element 102 in the mounted state of the impact element 110. The pyramidal region 113 is provided so that liquid droplets are separated from the gas flow and thus removed from the gas flow and can reach the liquid reservoir 50. In the other segment 114, a cover device 120 is arranged. The cover device 120 is formed as an elevation on the impact element 110.

As shown in FIG. 7, the impact element 110 is substantially embodied ring-shaped and comprises at one side a rim 111 and at the opposite side a pin 115. The pin 115 serves for guiding during assembly and for locking the impact element 110 at the liquid reservoir 50. For this purpose, the liquid reservoir 50 comprises a spike, not identified in more detail, that projects into the interior of the pin 115.

Figure 9:
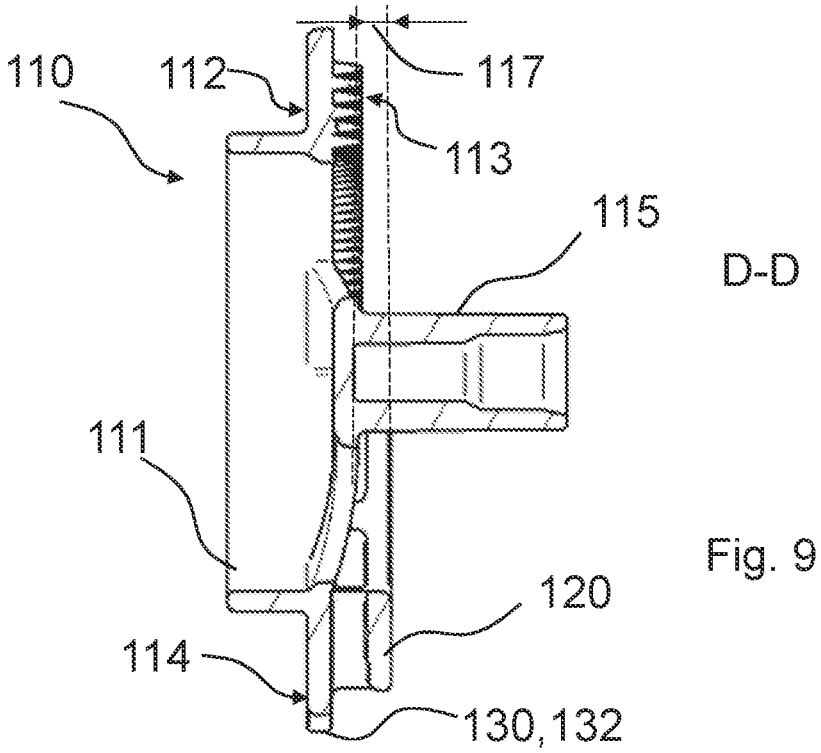
FIG. 9 shows a section view in the plane D-D of the separation module according to FIG. 2.
Figure 10:
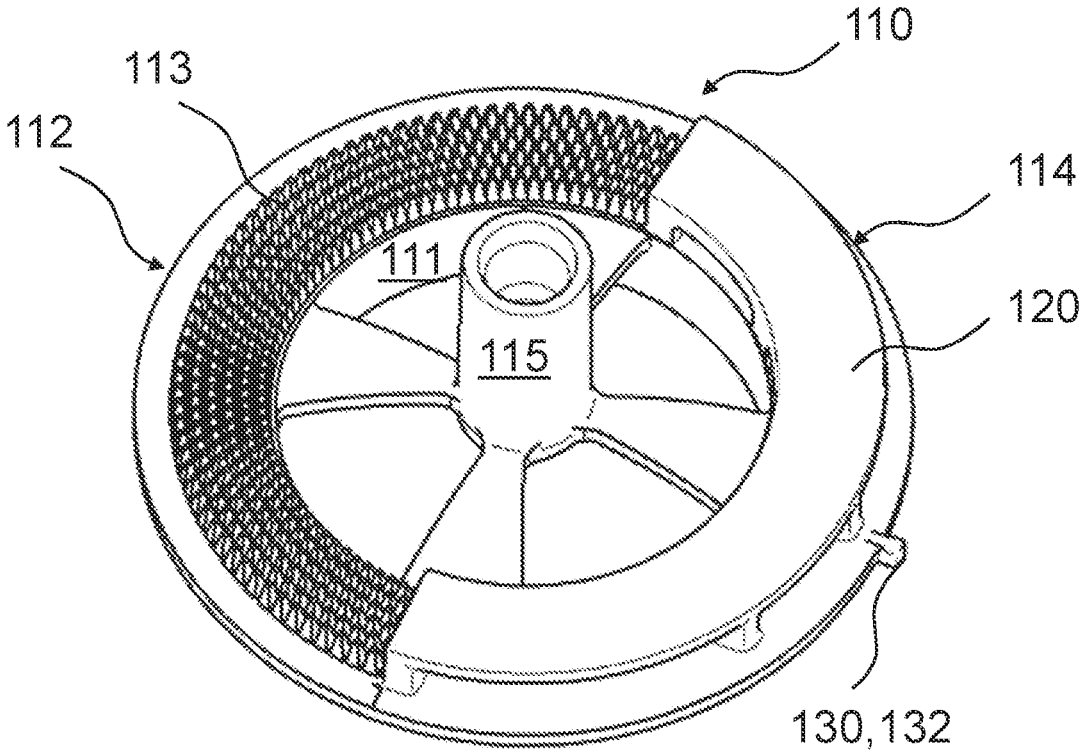
FIG. 10 shows a perspective view of a ring-shaped impact element with a cover device and a positioning element according to an embodiment of the invention.

The impact element 110 is illustrated in more detail in FIG. 9 with plan view of the section plane D-D (FIG. 6) and in FIG. 10 in perspective plan view. As can be seen in FIG. 9, a height offset 117 is present between the end of the pyramidal region 113 and the cover device 120. This means that in the mounted state the pyramidal region 113 of the impact element 110 comprises a greater distance from the nozzle arrangement of the nozzle carrier element 102 than the cover device 120.

FIG. 7 shows the separation module 100 with liquid reservoir 50 as a plan view of the section plane B-B (FIG. 4). FIG. 8 shows the separation module 100 with nozzle carrier element 102 and impact element 110 in plan view of the angled section plane C-C (FIG. 5) in detail. As can be seen in FIG. 8, the distance 116 of the pyramidal region 113 from the nozzles 106 is greater than the distance 118 of the cover device 120 from the nozzles 108 of the nozzle arrangement 104 of the nozzle carrier element 102. Preferably, the distance 118 is at most 50% of the distance 116, preferably at most 10%, particularly preferred at most 5%. The pyramidal region 113 of the impact element 110 is arranged downstream opposite the nozzles 106 (FIG. 7, FIG. 8) while the cover device 120 is arranged downstream of the nozzles 108. The nozzles 106 can be flowed through practically freely while a gas flow through the covered nozzles 108 is greatly limited or even completely prevented. Preferably, the through-flow of the gas flow through the nozzles 108 in comparison to nozzles 106, which are free from the cover device 120, is reduced by at least 50%, preferably by at least 90%, particularly preferred by at least 95%.

Figure 11:
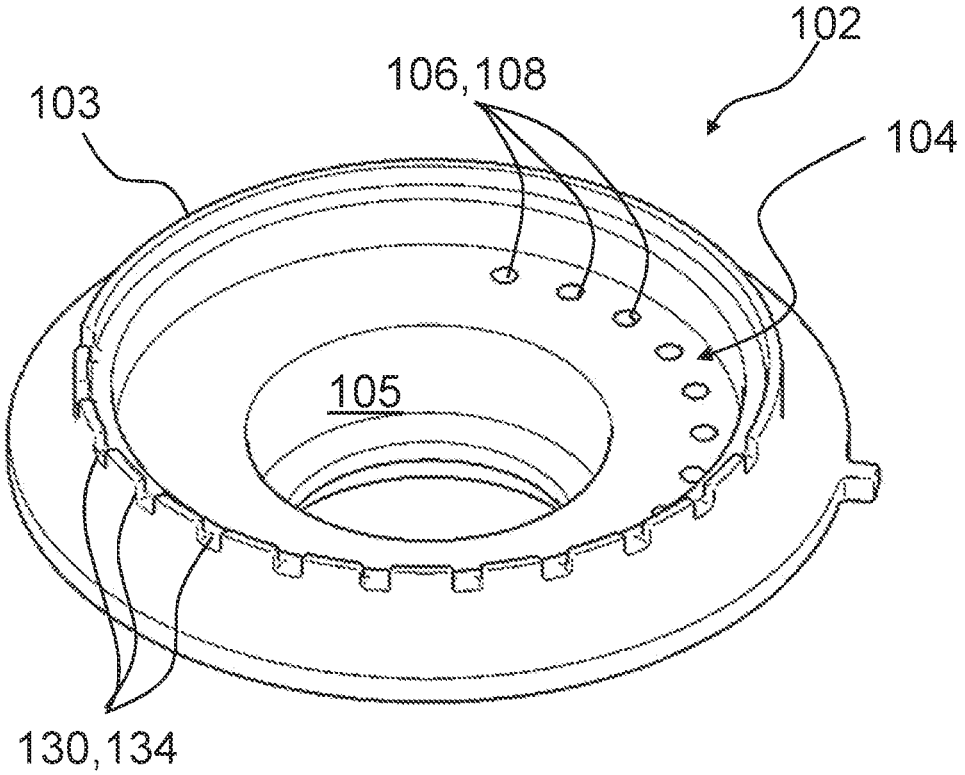
FIG. 11 shows a perspective view of a ring-shaped nozzle carrier element with positioning elements according to an embodiment of the invention.

FIG. 11 shows the ring-shaped nozzle carrier element 102 in detail in a perspective view with positioning elements 134 of the positioning device 130. The rim 103 is provided at its free end in sections with teeth whose intermediate spaces form the receptacles 134 for the complementary pin 132 at the impact element 110. The rim 103 is arranged on one side of the nozzle carrier element 102, on the other side a rim 105 with a smaller diameter is arranged with which the nozzle carrier element 102 is in contact with a receptacle of the liquid reservoir 50, for example, is inserted.

The nozzle arrangement 104 is formed by a semicircular arrangement of nozzles 106, 108. For reasons of simplification, only some are identified with reference characters. Depending on positioning of the pin 132 in the receptacles 134, nozzles 106 are arranged opposite the pyramidal region 113 and can be flowed through substantially freely while other nozzles 108 are arranged opposite the cover device 120 and are essentially covered by it downstream.

The separation module 100 can be fixedly connected to the top part 22 of the housing, for example, glued or welded or embodied as an injection-molded part. Alternatively, a form-fit connection is to be provided. The separation module 100 and the top part 22 of the housing are advantageously seal-tightly arranged relative to each other.

Beneficially, the nozzle carrier element 102 and the impact element 110 can be connected fixedly to each other, for example, glued or welded.

FIGS. 12 to 16 show a separation module 100 of a separator 10 according to a further embodiment of the invention.

The configuration of nozzle carrier element 102 and impact element 110 is largely identical to the preceding embodiment so that for avoiding unnecessary repetitions reference is being had to FIGS. 2-11 for details. In contrast to the preceding embodiment, the impact element 110 however has no cover device and no positioning device 130.

Figure 12:
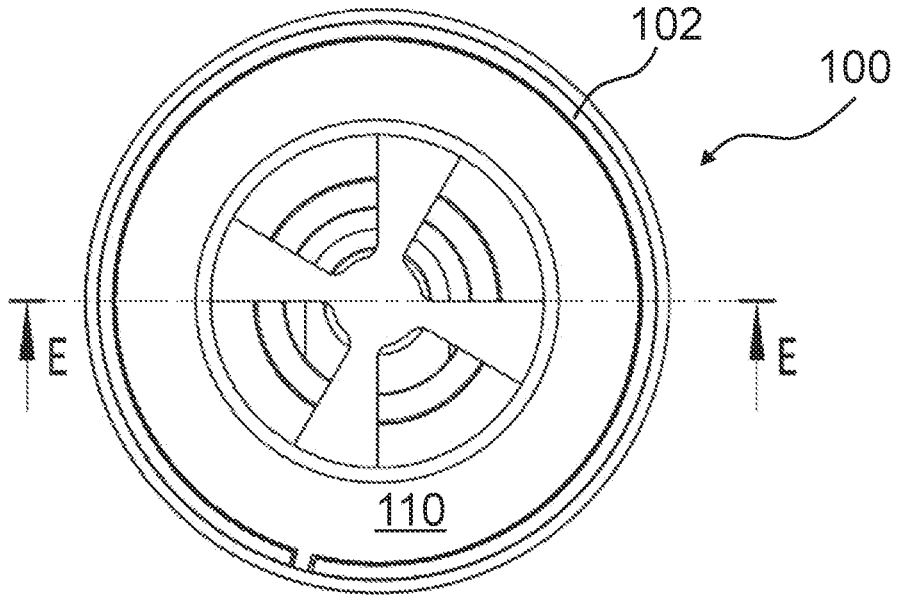
FIG. 12 shows a separation module of a separator according to a further embodiment of the invention with indicated section plane E-E in plan view with a cover element mounted upstream.
Figure 13:
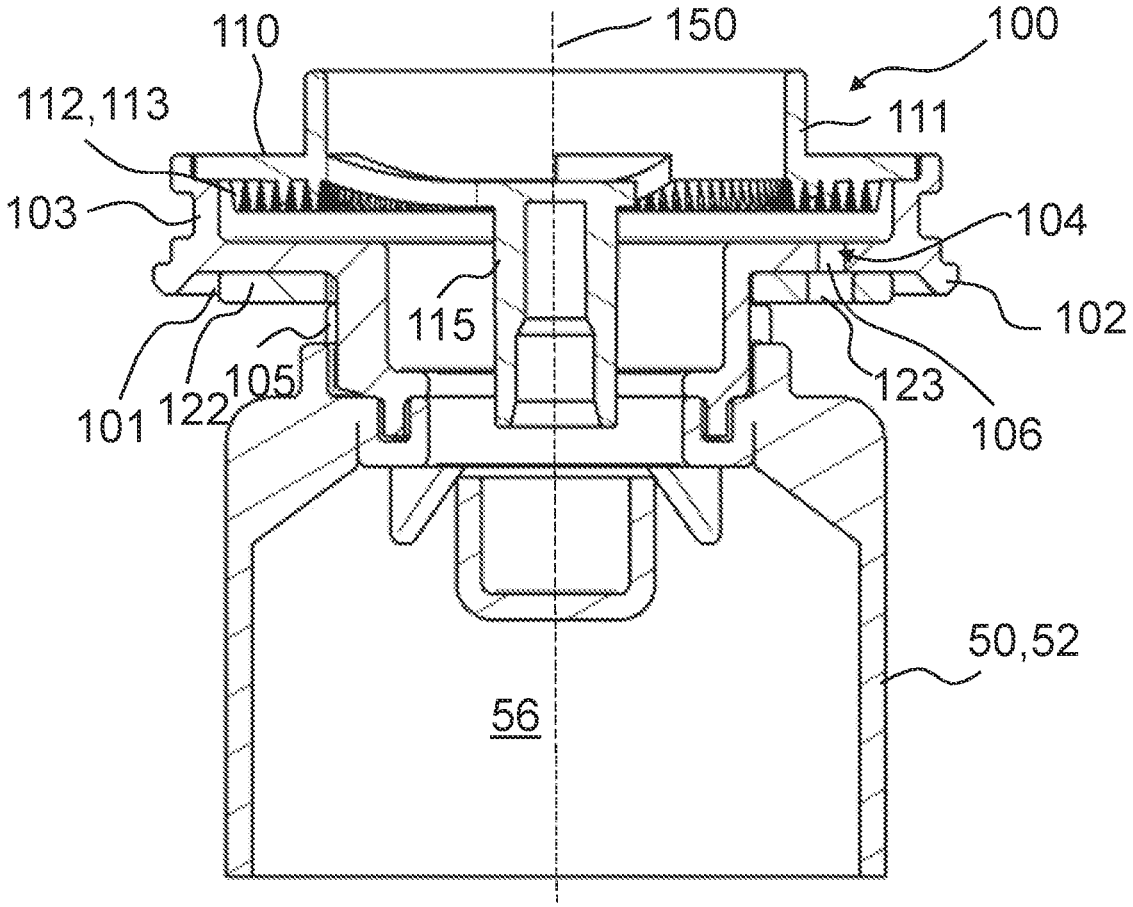
FIG. 13 shows a section view in the plane E-E of the separation module of the separator according to FIG. 12.
Figure 14:
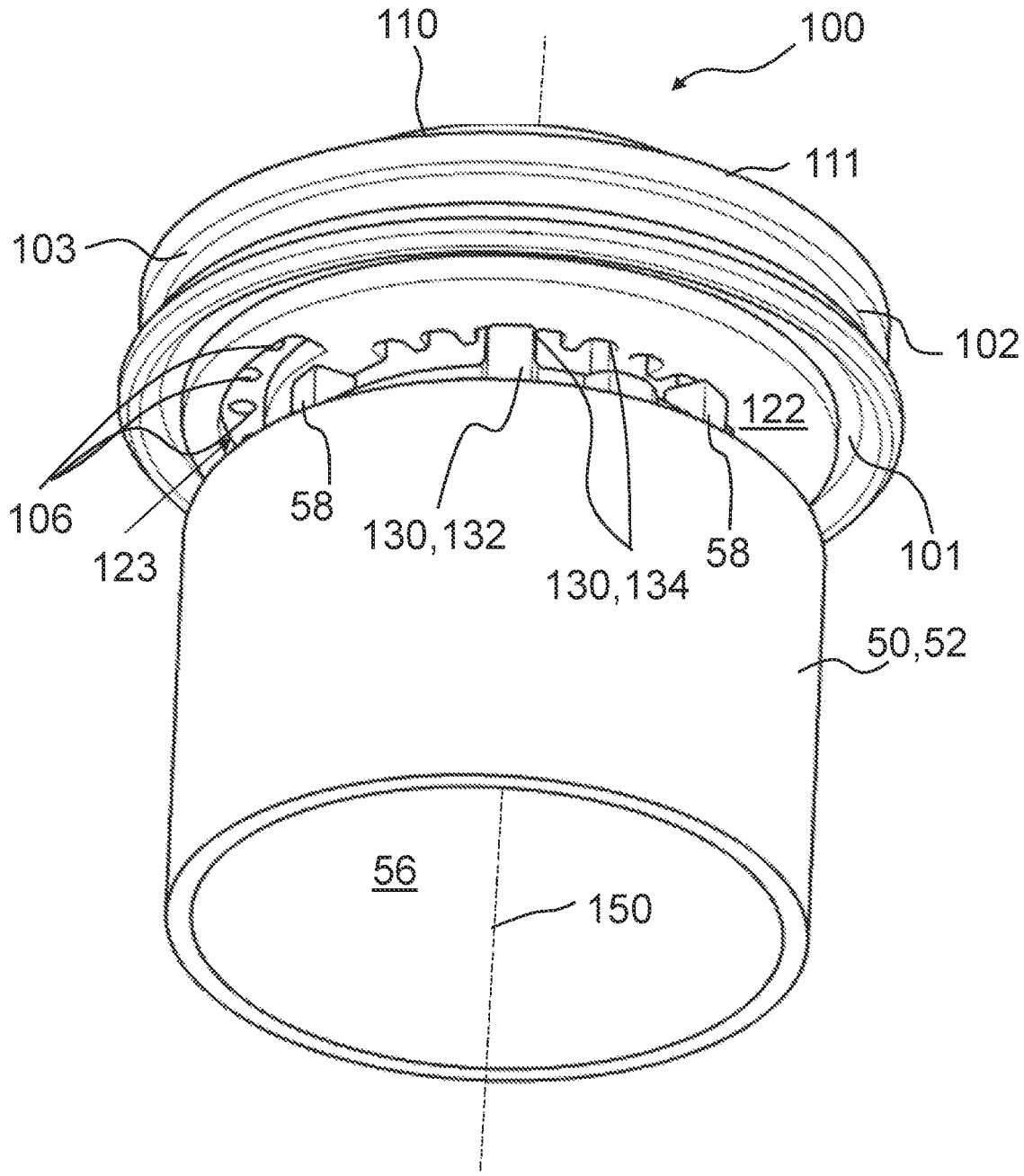
FIG. 14 shows the separation module of the separator according to FIG. 12 in perspective view.
Figure 15:
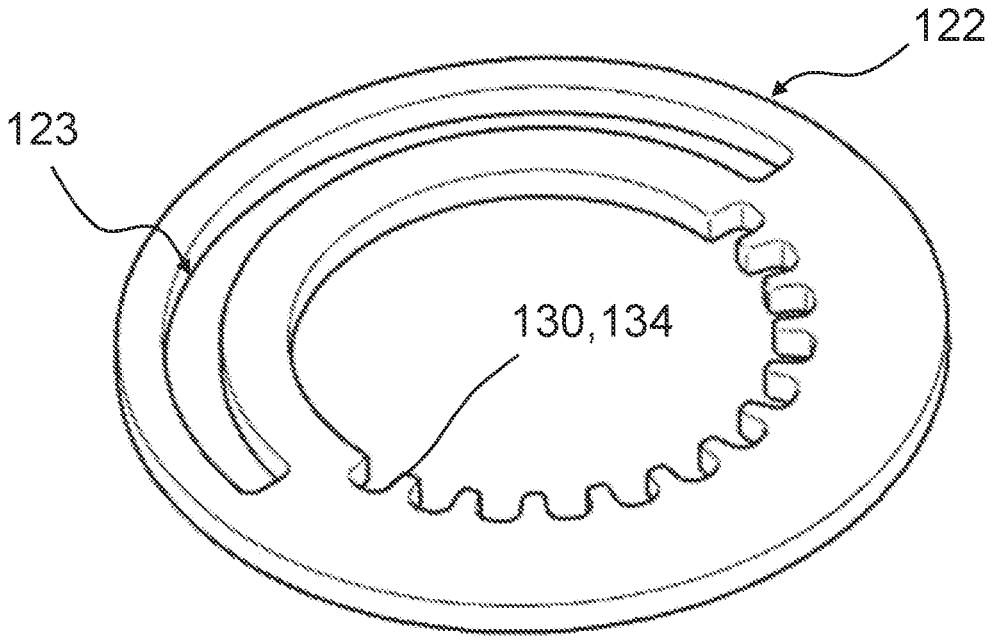
FIG. 15 shows a view of the cover element according to FIG. 12.
Figure 16:
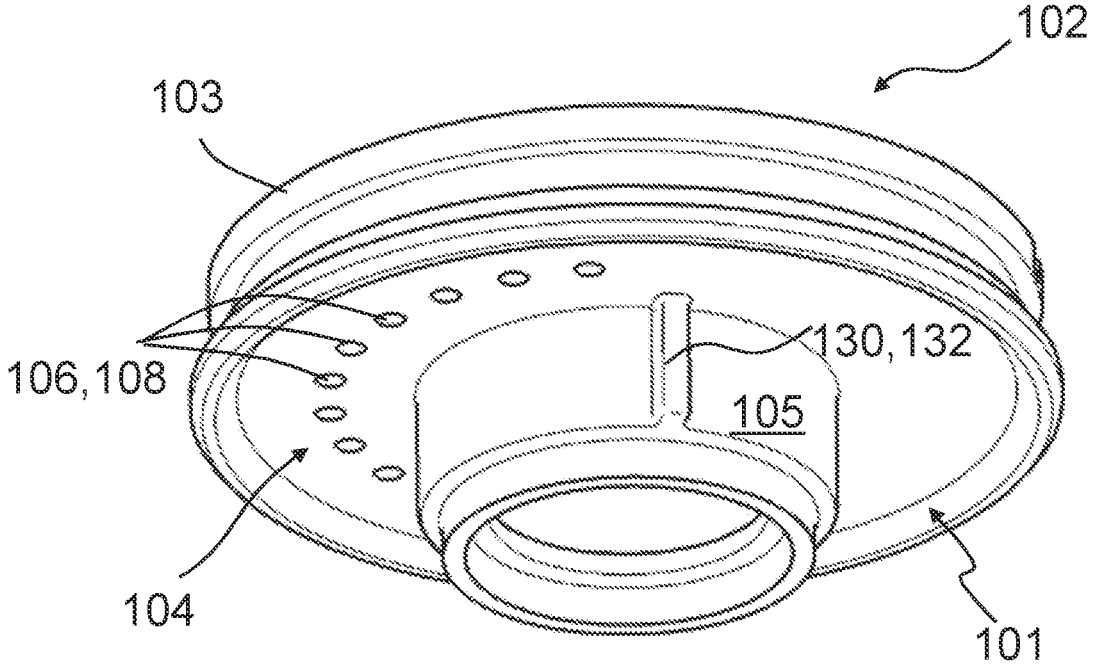
FIG. 16 shows a view of the nozzle carrier element according to FIG. 12.

FIG. 12 shows in plan view the separation module 100 with indicated section plane E-E with a ring-shaped cover device 122 which, in relation to the nozzle device 104 of the nozzle carrier element 102, is mounted upstream. FIG. 13 shows a section view in the plane E-E of the separation module 100 and a top part 52 of the liquid reservoir 50. FIG. 14 shows in perspective view the separation module 100 and the top part 52 of the liquid reservoir 50. FIG. 15 shows a view of the cover device 122, and FIG. 16 shows a view of the nozzle carrier element 102.

As can be seen in FIGS. 13, 14 in section view and perspective view, the ring-shaped cover device 122 is arranged upstream of the nozzle arrangement 104. The cover device 122 is designed as a ring and arranged in a ring-shaped recess 101 at the bottom side of the nozzle carrier element 102. The cover device 122 comprises at the inner circumference a region with teeth as positioning device 130 wherein the intermediate spaces between the teeth form receptacles as positioning elements 134 for receiving a complementary positioning element 132, for example, a pin.

Beneficially, as many receptacles 134 as correspond to the maximal number of nozzles 106, 108 can be provided.

The ring-shaped cover device 122 can be placed simply loosely between the nozzle carrier element 102 and the top part 52 of the liquid reservoir 50 and pressed with supports 58 against the bottom side of the nozzle carrier element 102.

A through-flow of the gas flow through the cover device 122 is enabled by a circular arc-shaped opening 123 which exposes nozzles 106 of the nozzle arrangement 104. This can be seen in FIG. 15. In other regions, the cover device covers the nozzle arrangement 104.

When in a particular embodiment the cover device 122 is not required for the technical function, it can be omitted when assembling the device.

In FIG. 16, the complementary positioning element 132 in the form of a pin can be seen which is arranged at socket 105 of the nozzle carrier element 102. The ring-shaped cover device 122 is thus pushed across the socket 105 and the positioning element 132 such that by the selection of one of the complementary positioning elements 134 at the inner circumference of the cover device 122 a desired number of nozzles 106 are exposed and other nozzles 108 are covered as needed.

In this embodiment, the positioning elements 132, 134 of the positioning device 130 can also be arranged interchanged.

The separation module 100 can be fixedly connected to the top part 22 of the housing, for example, glued or welded or embodied as an injection-molded part. Alternatively, a form-fit connection is to be provided. The separation module 100 and the top part 22 of the housing are advantageously seal-tightly arranged relative to each other.

The nozzle carrier element 102 can be connected with the housing parts by injection molding or with form fit. Alternatively, the nozzle carrier element 102 can be welded to another component or fixedly connected in another way.

Beneficially, the nozzle carrier element 102 and the impact element 110 can be fixedly connected to each other, for example, glued or welded.

Figure 17:
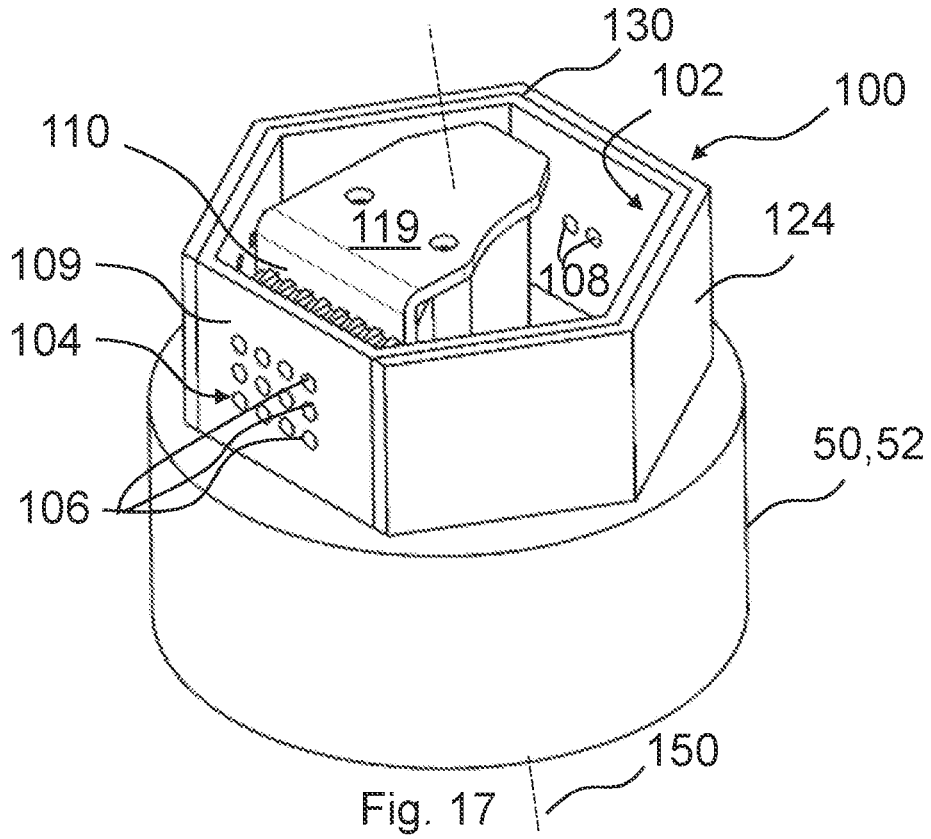
FIG. 17 shows a separation module of a separator according to a further embodiment of the invention in perspective view with impact element and nozzle carrier element as wall elements.
Figure 18:
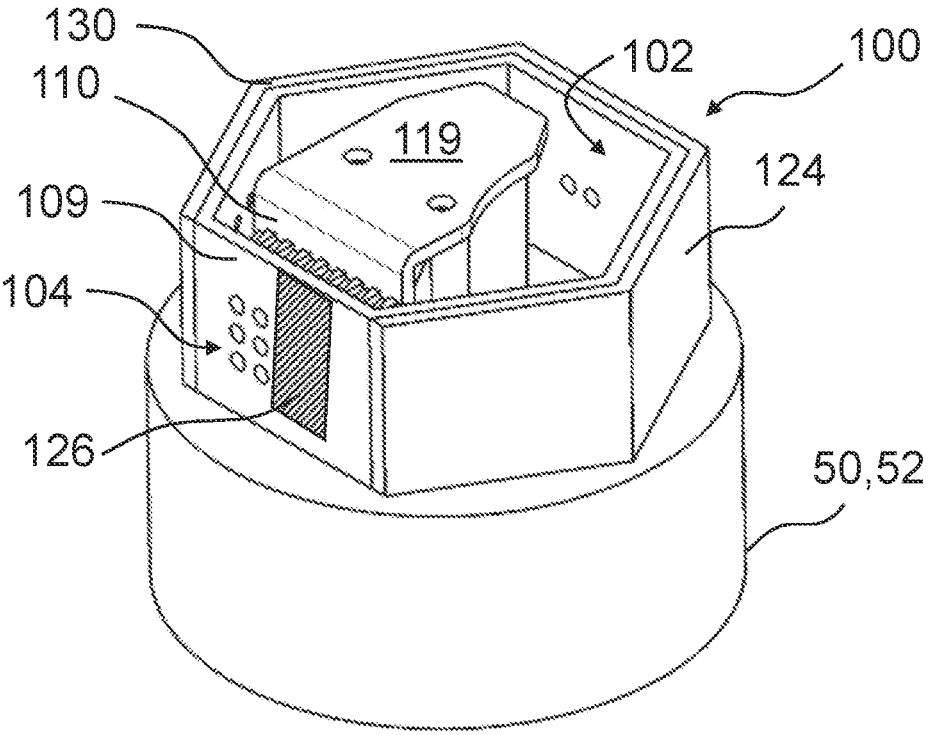
FIG. 18 shows a variant of the separation module of the separator according to FIG. 17 in perspective view with a cover device mounted upstream.
Figure 19:
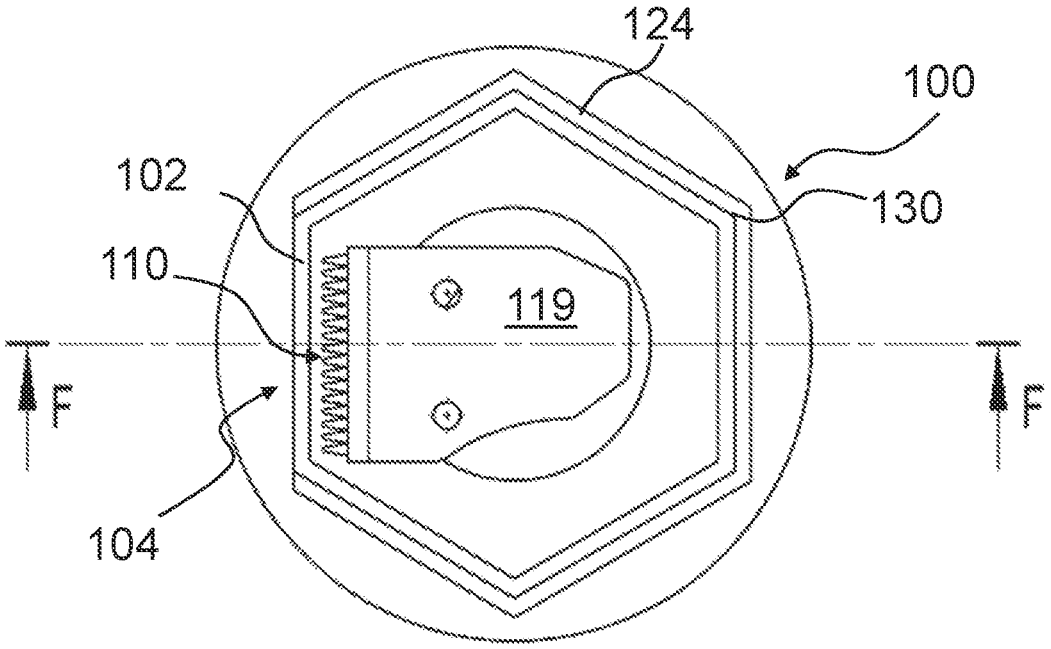
FIG. 19 shows the separation module of the separator according to FIG. 17 with indicated section plane F-F in plan view.
Figure 20:
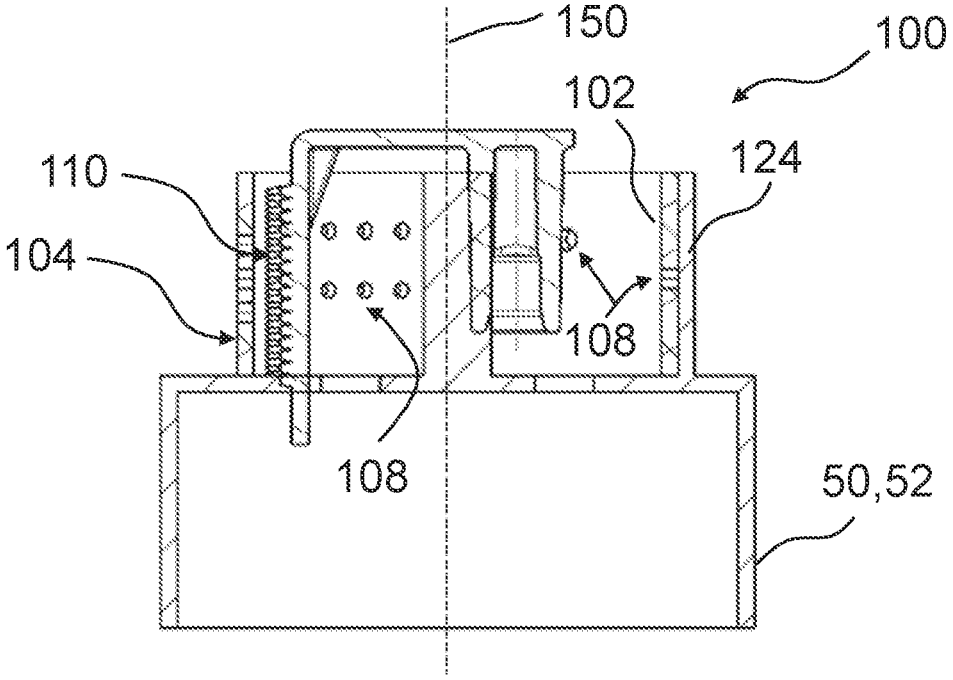
FIG. 20 shows a section view in the plane F-F of the separation module according to FIG. 17.
Figure 21:
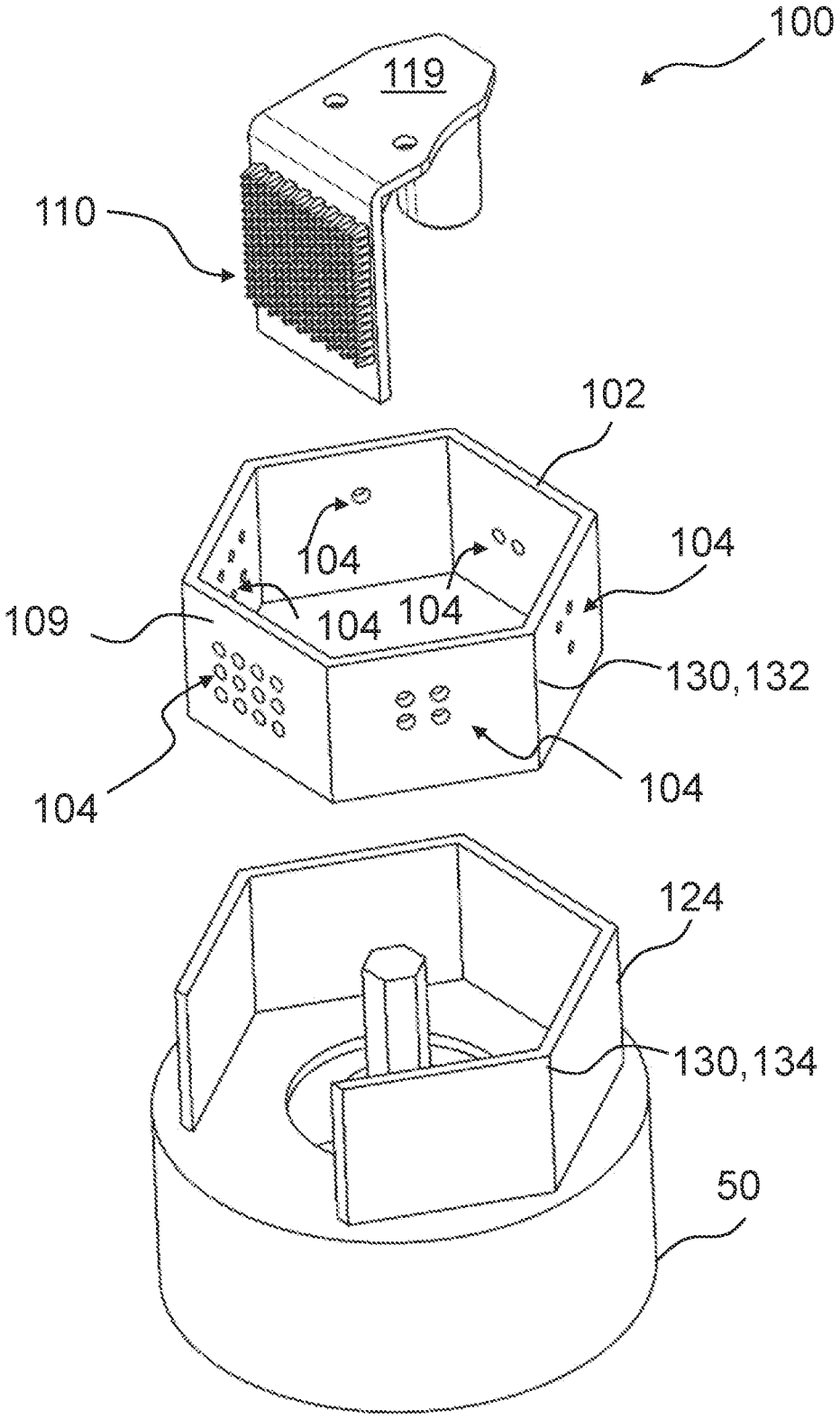
FIG. 21 shows an exploded illustration of the separation module according to FIG. 17.

FIGS. 17 to 21 show a separation module 100 of a separator 10 according to a further embodiment of the invention. FIG. 17 shows in perspective view the separation module 100, and FIG. 18 shows in perspective view a variant of the separation module 100 according to FIG. 17. FIG. 19 shows in plan view the separation module 100 with indicated section plane F-F, and FIG. 20 shows a section view in the plane F-F of the separation module 100. FIG. 21 shows an exploded illustration of the separation module 100 according to FIG. 17.

In this embodiment, impact element 110 and nozzle carrier element 102 are arranged coaxially about the axis 150. The nozzle carrier element 102 is embodied as a polygonal hexagonal tube body and comprises on several lateral surfaces, for example, on each lateral surface, a nozzle arrangement 104 with a different number of nozzles 106, 108. The cover device 124 surrounds in this context the nozzle carrier element 102 with the exception of one lateral surface 109 so that the nozzles 106 in this lateral surface 109, of which for reasons of simplification only some are identified with reference characters, can be flowed through by a gas flow.

It is understood that the nozzle carrier element 102 and the cover device 124 can also be interchanged and the cover device 124 can be arranged downstream of the nozzle carrier element 102.

The positioning device 130 is formed by the corners of nozzle carrier element 102 and cover device 124. The rotatory position of nozzle carrier element 102 relative to the cover device 124 determines which nozzle arrangement 104 can be flowed through and which is covered.

In the illustrated embodiment, the cover device 124 can be embodied as one piece together with the top part 52 of the liquid reservoir 50. The nozzle carrier element 102 can be pushed simply into the cover device 124. Optionally, instead of the cover device 124, the nozzle carrier element 102 can be connected fixedly to the liquid reservoir 50.

The impact element 110 is arranged as an impact plate downstream of the lateral surface 109 and parallel thereto. The impact element 110 is embodied as angled element and fastened with a support plate 119 to a central pin of the top part 52 of the liquid reservoir 50.

The configuration in FIG. 18 provides that additionally at the lateral surface 109 a cover device 126 in the form of a cover can be arranged upstream in front of the nozzle arrangement 104 and can additionally cover a part of the nozzle arrangement 104 in the otherwise permeable wall element 109.

Optionally, one or more cover devices 126 can also replace the cover device 124.

The different configurations according to the invention of the separation module 100 of the separator 10 permit advantageously making available an assembly kit for the separator 10 with carry over parts for different through-flows of a gas flow in a crankcase venting system 200.

Preferably, the assembly kit comprises carry over parts in the form of a nozzle carrier element 102 with at least one nozzle arrangement 104 which comprises at least one nozzle 106, 108; an impact element 110 for arrangement downstream of the nozzle arrangement 104; as well as a cover device 120, 122, 124, 126 for one or more nozzles 108 of the nozzle arrangement 104 that reduces by at least 50% a through-flow of the gas flow through the one or more nozzles 108 in comparison to nozzles 106 that are free from the cover device 120, 122, 124, 126; as well as a liquid reservoir 50. Moreover, the ring-shaped cover element 122 can be provided as carry over part.

The number of nozzles 106 that are free from a cover device 120, 122, 124, 126 can be selected depending on a required differential pressure that is a function of the through-flow rate of the blow-by gas.

With particular advantage, the nozzle carrier elements 102, the impact element 110, the liquid reservoir 50 can be configured as carry over parts. The nozzle carrier element 102 can comprise a maximal number of nozzles 106, 108. Due to the positioning device 130 with complementary positioning elements 132, 134, it can be determined by a suitable arrangement of the complementary positioning elements 132, 134 which nozzles 106 can be substantially freely flowed through and which nozzles 108 are covered. Likewise, the ring-shaped cover element 122 can be configured as carry over part.

For example, maximally twelve nozzles can be provided in the nozzle arrangement 104 and a through-flow region with minimal through-flow through one nozzle 106 and maximal through-flow through all twelve nozzles 106 can be exploited.

What is claimed is:

1. A separator configured to separate a liquid from a gas flow, the separator comprising:

a nozzle carrier element comprising a nozzle arrangement comprising one or more nozzles;

an impact element arranged downstream in a flow direction of the gas flow at least partially opposite the nozzle arrangement;

a permanent cover device configured to cover at least one of the one or more nozzles of the nozzle arrangement, wherein the permanent cover device is configured to reduce by at least 50% a through-flow of the gas flow through the at least one of the one or more nozzles of the nozzle arrangement in comparison to the one or more nozzles of the nozzle arrangement that are free from the permanent cover device.

2. The separator according to claim 1, wherein a downstream distance measured between the at least one of the one or more nozzles of the nozzle arrangement covered by the permanent cover device and the permanent cover device is smaller by at least 50% than a downstream distance measured between the one or more nozzles of the nozzle arrangement that are free from the permanent cover device and the impact element.

3. The separator according to claim 1, wherein the nozzle carrier element and the impact element comprise a positioning device comprising complementary positioning elements configured to fix a relative position of the permanent cover device and of the nozzle arrangement relative to each other.

4. The separator according to claim 1, wherein the permanent cover device is arranged upstream of the nozzle arrangement in the flow direction of the gas flow.

5. The separator according to claim 4, wherein a distance measured between the at least one of the one or more nozzles of the nozzle arrangement covered by the permanent cover device and the permanent cover device is smaller by at least 50% than a distance measured between the impact element and the one or more nozzles of the nozzle arrangement that are free from the permanent cover device.

6. The separator according to claim 4, wherein the nozzle carrier element and the permanent cover device comprise a positioning device comprising complementary positioning elements configured to fix a rotatory position between the permanent cover device and the nozzle arrangement.

7. The separator according to claim 1, wherein the nozzle carrier element comprises a receptacle and the impact element is arranged in the receptacle.

8. The separator according to claim 1, further comprising a liquid reservoir, wherein the nozzle carrier element is arranged in a receptacle of the liquid reservoir.

9. The separator according to claim 1, wherein the permanent cover device is integrated in the impact element.

10. The separator according to claim 1, wherein the permanent cover device is a flat ring.

11. The separator according to claim 1, wherein the permanent cover device is a ring-shaped body with a round cross section or an angular cross section.

12. The separator according to claim 1, wherein the permanent cover device is a cover.

13. The separator according to claim 1, wherein the impact element and the nozzle carrier element are concentrically or coaxially arranged about an axis of the separator.

14. The separator according to claim 1, wherein the nozzle arrangement is arranged as a circular segment or as a ring segment in the nozzle carrier element.

15. The separator according to claim 14, wherein the nozzle carrier element and the impact element are arranged perpendicularly to the axis of the separator.

16. The separator according to claim 1, wherein the nozzle carrier element comprises a wall segment arranged parallel to an axis of the separator and wherein the nozzle arrangement is arranged in the wall segment.

17. The separator according to claim 16, wherein the nozzle carrier element and the impact element are arranged parallel to the axis of the separator.

18. An assembly kit configured to produce a separator according to claim 1, the assembly kit comprising:

a nozzle carrier element comprising a nozzle arrangement comprising one or more nozzles;

an impact element configured to be arranged downstream of the nozzle arrangement;

a cover device configured to cover at least one of the one or more nozzles of the nozzle arrangement and to reduce by at least 50% a through-flow of a gas flow through the at least one of the one or more nozzles of the nozzle arrangement in comparison to the one or more nozzles of the nozzle arrangement that are free from the cover device;

a liquid reservoir configured to collect a liquid separated from the gas flow;

wherein at least the nozzle carrier element, the impact element, and the liquid reservoir are provided as carry over parts for different ones of the nozzle arrangement and/or a different number of nozzles of the nozzle arrangement.

19. The assembly kit according to claim 18, further comprising complementary positioning elements disposed at the nozzle carrier element and at the impact element, wherein the complementary positioning elements are configured to fix a relative position between the cover device and the nozzle arrangement.

20. The assembly kit according to claim 18, wherein the cover device is configured to coaxially surround the nozzle carrier element.

* * * * *